US006206403B1

(12) United States Patent
Black et al.

(10) Patent No.: US 6,206,403 B1
(45) **Date of Patent: *Mar. 27, 2001**

(54) SNOWBOARD STRAP BINDING

(75) Inventors: Steve Black, Portland, OR (US); Gary Eckwortzel, Ojai, CA (US); Chris Hamilton, Portland; Chris Robinette, Lake Oswego, both of OR (US); Barry Sween, Santa Monica, CA (US)

(73) Assignee: Nike International, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/105,498

(22) Filed: Jun. 26, 1998

(51) Int. Cl.[7] ..... A63C 9/00; A63C 5/03

(52) U.S. Cl. ..... 280/618; 280/14.22; 280/620

(58) Field of Search ..... 280/14.2, 617, 280/618, 620, 623, 625, 633, 634, 14.21, 14.22, 14.24; 36/117.1, 117.9, 50.5, 123, 125, 117.6, 117.7, 117.8

(56) References Cited

U.S. PATENT DOCUMENTS

| | | | | |
|---|---|---|---|---|
| 5,261,689 | * | 11/1993 | Carpenter et al. | 280/14.2 X |
| 5,480,176 | * | 1/1996 | Sims | 280/618 |
| 5,609,347 | * | 3/1997 | Dressel | 280/14.2 |
| 5,692,765 | * | 12/1997 | Laughlin | 280/619 |
| 5,713,587 | | 2/1998 | Morrow et al. | 280/14.2 |
| 5,727,797 | * | 3/1998 | Bowles | 280/14.2 |
| 5,758,895 | * | 6/1998 | Bumgarner | 280/14.2 |
| 5,771,609 | * | 6/1998 | Messmer | 36/177.8 |
| 5,816,603 | * | 10/1998 | Borsoi | 280/14.2 |
| 5,820,139 | * | 10/1998 | Grindl | 280/14.2 |
| 5,857,700 | * | 1/1999 | Ross | 280/14.2 |
| 5,901,971 | * | 5/1999 | Eaton | 280/14.2 |
| 5,918,897 | * | 7/1999 | Hansen et al. | 280/14.21 |
| 5,971,407 | * | 10/1999 | Zemke et al. | 280/14.22 |
| 6,056,300 | * | 5/2000 | Carpenter et al. | 280/14.22 |
| 6,076,848 | * | 6/2000 | Rigal et al. | 280/634 |

FOREIGN PATENT DOCUMENTS

| | | | |
|---|---|---|---|
| 0 824 942 A1 | * | 2/1998 | (EP) . |
| 9-206420 | * | 8/1997 | (JP) . |

* cited by examiner

*Primary Examiner*—Lanna Mai
*Assistant Examiner*—Ruth Ilan
(74) *Attorney, Agent, or Firm*—Banner & Witcoff, Ltd.

(57) ABSTRACT

There is disclosed a snowboard binding system for a soft style snowboard boot. The snowboard binding system includes a base plate mounted to the snowboard and a toe strap unit, a heel loop, and a highback mounted to the base plate. Mounted to the heel loop is a secondary strap device which wraps around the back of the boot. Wrapping over the top of the boot is the ankle strap unit which is mounted to the secondary strap device. The secondary strap device and ankle strap have a plurality of adjustment holes for selective adjustment of the binding for greater support or for more flexibility. The secondary strap device works in conjunction with the ankle strap to provide better heel hold to the snowboard, thereby resulting in enhanced snowboard performance. The secondary strap device also reduces the pressure exerted across the top of the boot from the ankle strap resulting in better comfort.

12 Claims, 6 Drawing Sheets

FIG.3
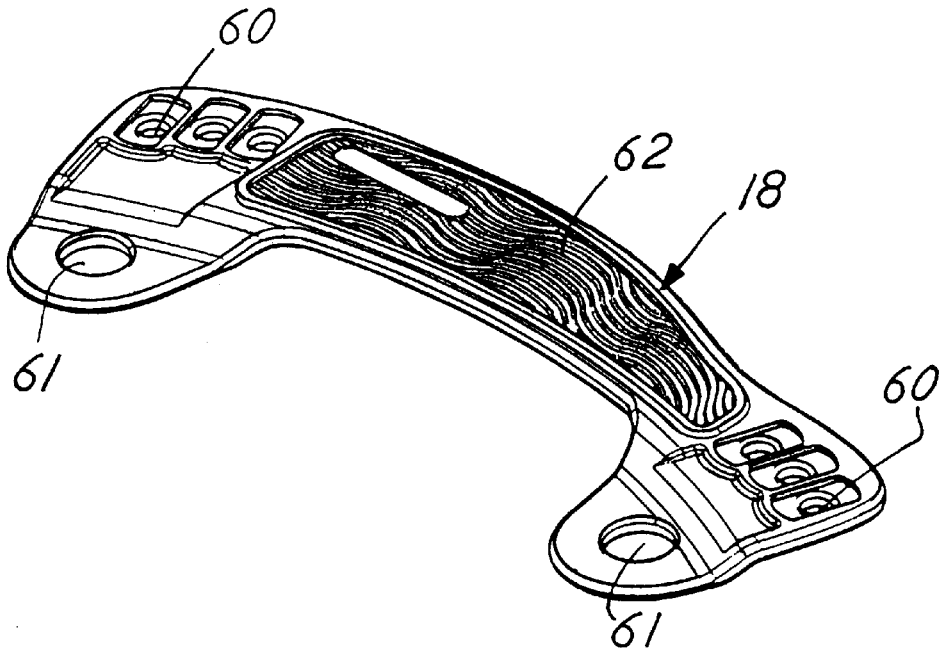
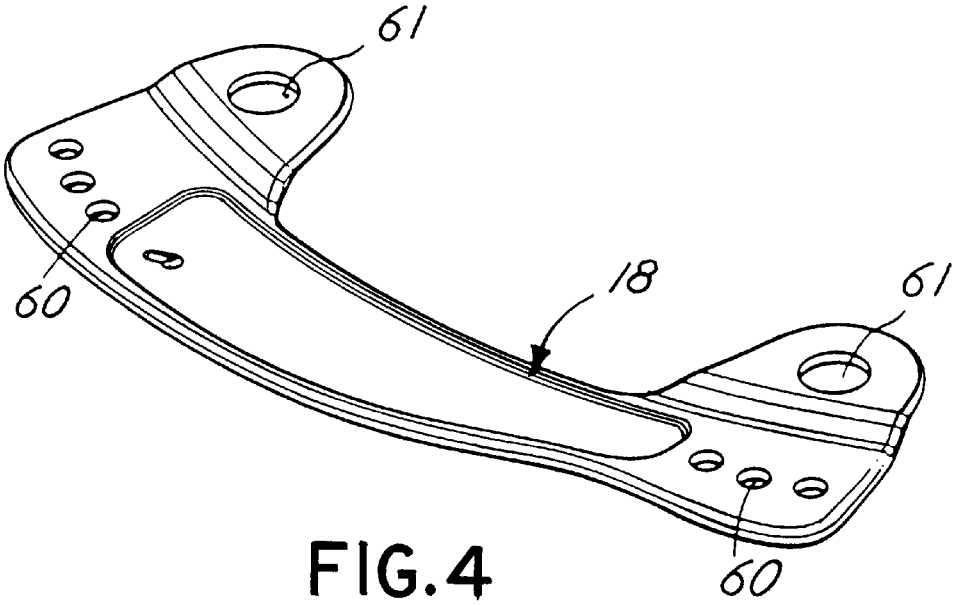
FIG.4

FIG.7
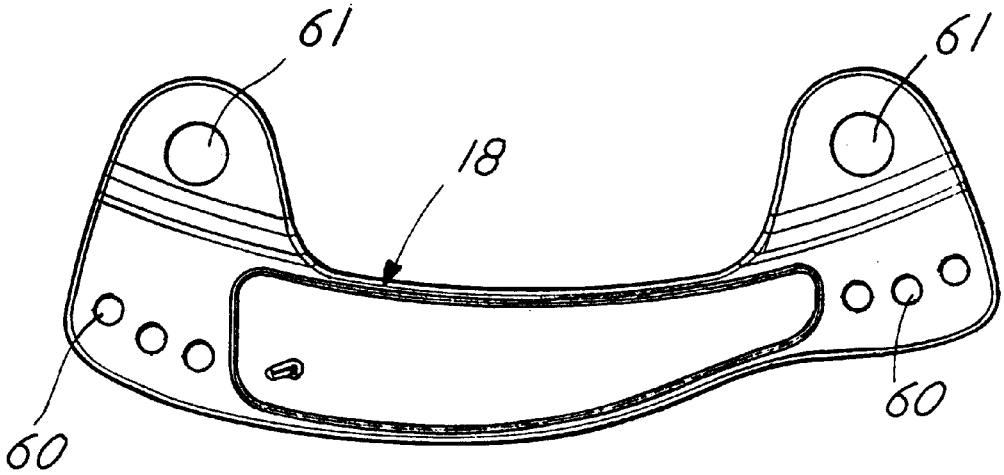
FIG.6
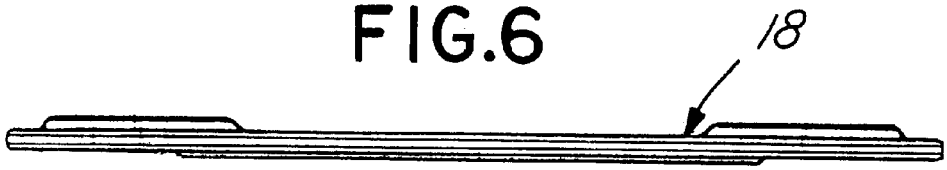
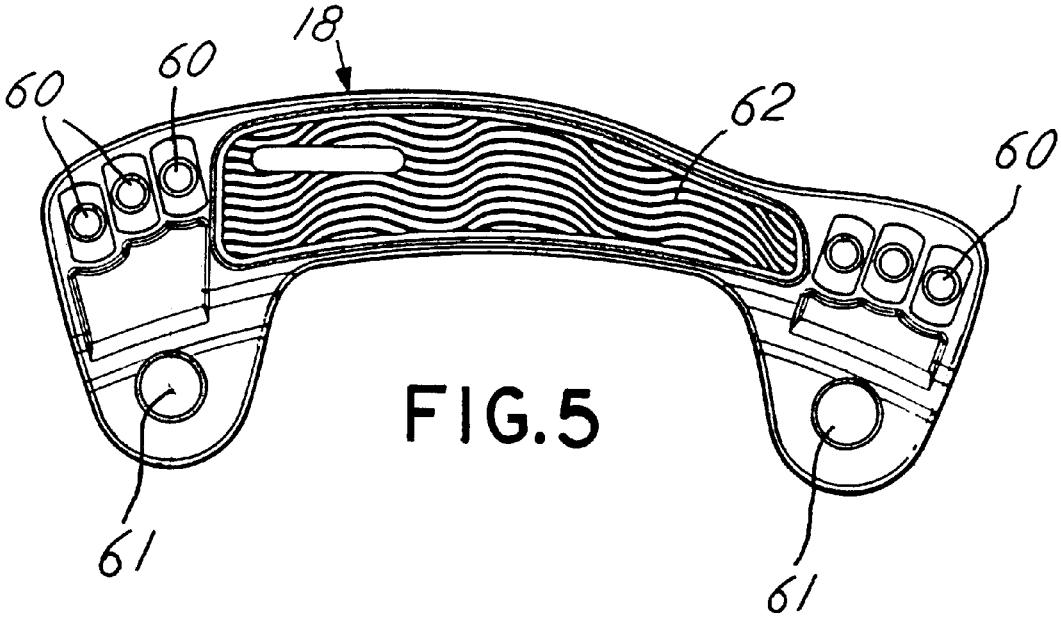
FIG.5

FIG.9
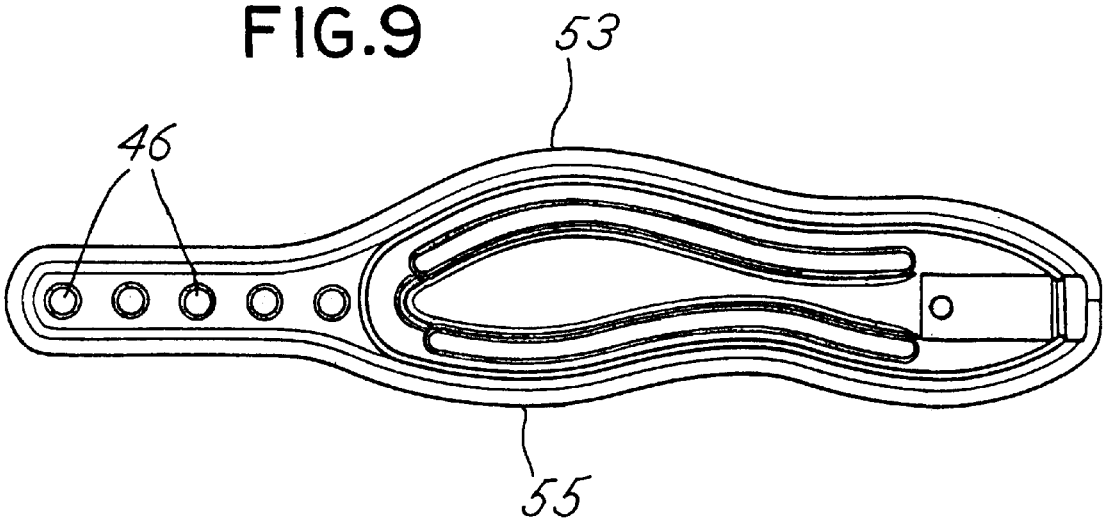
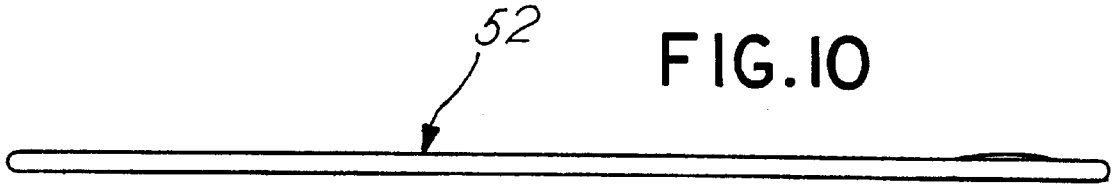
FIG.10
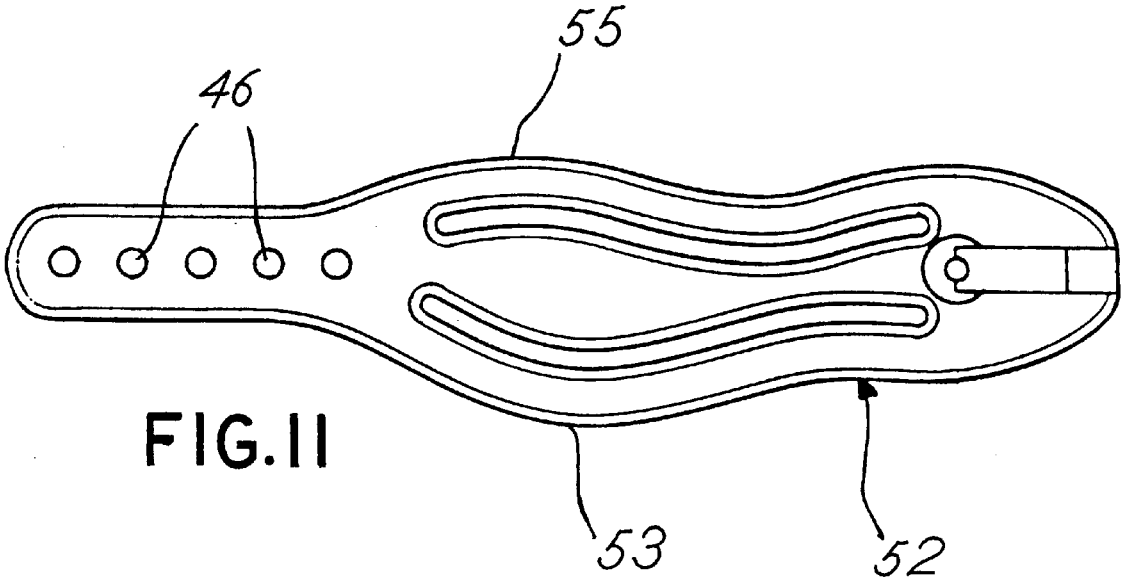
FIG.11

SNOWBOARD STRAP BINDING

BACKGROUND OF THE INVENTION

1. Field of the Invention

The present invention relates in general to snowboard bindings. More specifically, but without restriction to the particular use which is shown and described, this invention relates to a snowboard strap binding having a secondary ankle strap device. The secondary ankle strap device wraps around the back of the boot and improves the primary ankle strap performance by providing better heel hold with improved comfort.

2. Description of the Related Art

The sport of snowboarding has become an increasingly popular sport in recent years. Snowboard riders (hereinafter "snowboarders") are increasing in number and increasing the demand for high performance snowboards. To facilitate the high performance maneuvers made by snowboarders, the snowboarders require snowboard bindings that securely hold the snowboarder's boots to the snowboard to keep them in close association with the snowboard and thus the snow-covered slope.

When snowboarding, different styles of boots are used. Snowboard boots are typically characterized as either a soft boot (boots that have a flexible exterior), a hard boot (boots that have a hard exterior). Soft boots can also be configured as a step-in boot. Each of these types of boots have separate design considerations for the bindings. The hard snowboard boot bindings, for example, usually consist of a toe and heel piece fastened to the board for releasably clamping the toe and heel of the hard boot to the board. For a soft style snowboard boot, a popular binding is the strap binding.

The strap binding firmly holds the snowboard boot down to the board and provides a support structure to allow a snowboarder to control the board and also to transmit power to the snow. Conventional snowboard strap bindings for a soft boot consist of a binding base, a toe strap, an ankle strap, and a highback. A typical style of binding base includes a base plate with a relatively large hole in the center, with a corresponding mounting plate disc which engages the base plate hole. The mounting plate disc is bolted to the snowboard and thus secures the base plate to the board. The mounting plate allows for rotational positioning of the base plate to allow the snowboarder to change the stance orientation of the bindings relative to the snowboard for skilled maneuvering. The toe and ankle straps of the soft boot binding have essentially identical functionality. Each strap cooperates with the base plate for strapping over respective toe and ankle portions of the boot for securing the boot the snowboard. The highback is the structure of the strap binding that supports the back of the leg.

The known soft boot snowboard binding systems use only an ankle strap attached to the sides of the base plate to hold the heel of the boot down onto the snowboard. As conventional, the ankle strap only contacts the top of the foot to hold the heel down resulting in less than optimum heel hold down. This results in a less than desirable control of the snowboard since the snowboarder's heel is not always in contact with the board during skilled maneuvering. In addition, when increased pressure is applied against the conventional ankle strap as it is mounted to the base plate, the pressure is focused on the top of the foot creating discomfort for the snowboard rider. These and other disadvantages with existing soft boot bindings are overcome by the present invention.

SUMMARY OF THE INVENTION

Accordingly, an object of the present invention is to provide an improved snowboard binding system which enhances a snowboard riding experience.

It is a further object of the present invention to provide a snowboard binding that improves heel hold down while a snowboarder maneuvers the snowboard.

It is still a further object of the invention to provide a snowboard binding that improves user comfort by reducing the pressure exerted by the ankle strap on the top of the boot.

It is yet another object of the present invention to provide a secondary strap device that works in conjunction with the ankle strap to improve binding performance by providing a better heel hold with improved comfort.

The present invention is a strap binding that improves binding performance over traditional strap bindings. Improved snowboard binding performance is accomplished through the use of a secondary strap device, also known as a bootlock, which is a device that works in conjunction with the ankle strap unit in holding the heel down with less pressure applied across the top of the foot. When secured to the ankle strap, the bootlock works by applying downward pressure all the way around the back of the boot, above the heel, thus aiding in holding the heel down. During maneuvering of the snowboard, when increased pressure is applied against the ankle strap because the heel is lifting up from the board, the ankle strap pulls on the bootlock surrounding the back of the boot causing the bootlock to close tighter around the boot, thereby creating a resultant downward force which holds the heel down against the snowboard. Significantly, the increased pressure on the ankle strap is also dissipated around the boot and not focused on the top of the boot resulting in increased comfort for the snowboarder. Conversely, as the pressure decreases on the ankle strap, the tension placed on the back of the boot by the secondary strap device decreases. Other advantages of the bootlock, are tunable flexibility of the binding that many snowboarders require in a strap binding. This allows the snowboarder to adjust either the flex or support in the forward, medial and lateral directions. That is, the bootlock is adjustable to allow for increased stiffness or support on the boot creating a more responsive binding. Alternatively, the bootlock is adjustable for more flex which increases the range of boot motion. The bootlock is also designed with a textured surface that resists upward motion of the boot.

Briefly, the present invention provides for a snowboard binding comprising a base plate defining opposing side walls. The base plate is secured to the snowboard by a circular mounting plate that allows for the adjustment of the stance orientation of the snowboarder. A toe strap unit is mounted to the side walls of the base plate. Mounted to the back of the base plate is a heel loop on which is mounted the highback. Also mounted to the heel loop is the secondary strap device, or bootlock, which wraps around the back of the boot. The bootlock has a plurality of adjustment holes at each end on which the ankle strap unit is mounted. The ankle strap unit, which wraps over the top of the boot, includes an ankle strap also having a plurality of adjustment holes. The plurality of adjustment holes in the bootlock and in the ankle strap allow the snowboarder to adjust the binding for greater stiffness or for more flexibility depending on the desired performance of the board. For additional adjustment of the "fit" of the binding, the ankle strap is asymmetrical in shape. Depending on which side of the base plate the ankle strap is mounted, the asymmetric shape of the ankle strap provides either a tighter or a flexible binding fit. By simply switching the asymmetric ankle strap from one side of the base plate to the other, the snowboarder can further adjust the desired edge shape and pressure for enhanced board performance. In operation, as the snowboarder exerts upward pressure on the ankle strap, the ankle strap which cooperates with the bootlock, draws the bootlock tighter around the back of the boot, thereby keeping the heel of the boot down onto the snowboard for enhanced snowboard performance. By cooperating with the bootlock, the ankle strap exerts less focused pressure on the top of the boot, thereby creating less discomfort for the snowboarder.

The full range of objects, aspects and advantages of the invention are only appreciated by a full reading of this specification and a full understanding of the invention. Therefore, to complete this specification, a detailed description of the invention and the preferred embodiments follow, after a brief description of the drawings.

BRIEF DESCRIPTION OF THE DRAWINGS

The preferred embodiment of the invention will be described in relation to the accompanying drawings. In the drawings, the following figures have the following general nature:

FIG. 3 is an isometric front view of the secondary strap device of the invention of FIG. 1.

FIG. 4 is an isometric back view of the secondary strap device of FIG. 3.

FIG. 5 is a front elevation view of the secondary strap device of FIG. 3.

FIG. 6 is an edge view of the secondary strap device of FIG. 3.

FIG. 7 is a back elevation view of the secondary strap device of FIG. 3.

FIG. 9 is a front elevation view of the asymmetric ankle strap of FIG. 8.

FIG. 10 is an edge view of the asymmetric ankle strap of FIG. 8.

FIG. 11 is a back elevation view of the asymmetric ankle strap of FIG. 8.

DESCRIPTION OF THE PREFERRED EMBODIMENTS

Figure 1:
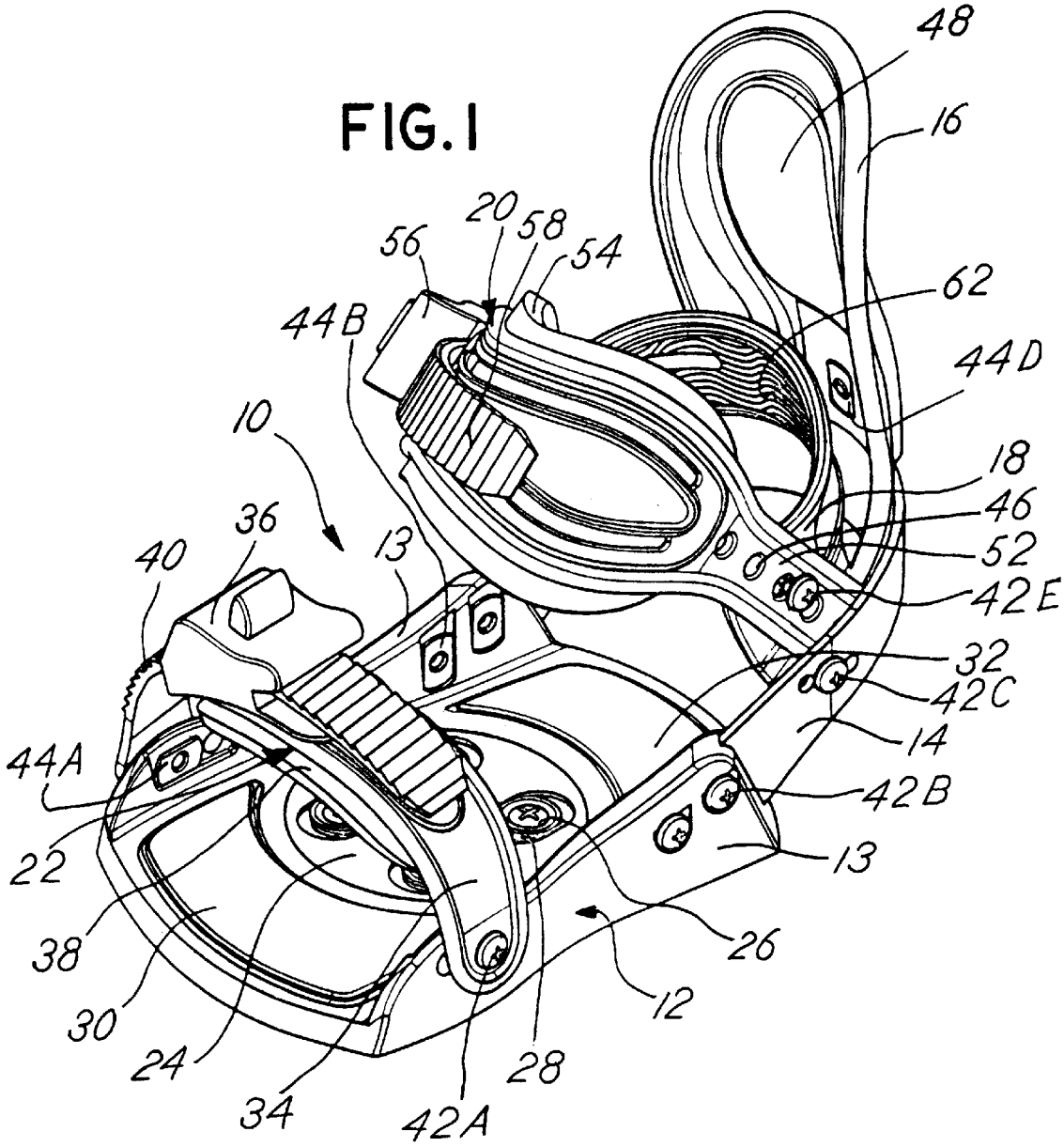
FIG. 1 is an isometric front view of the snowboard strap binding according to the present invention.
Figure 2:
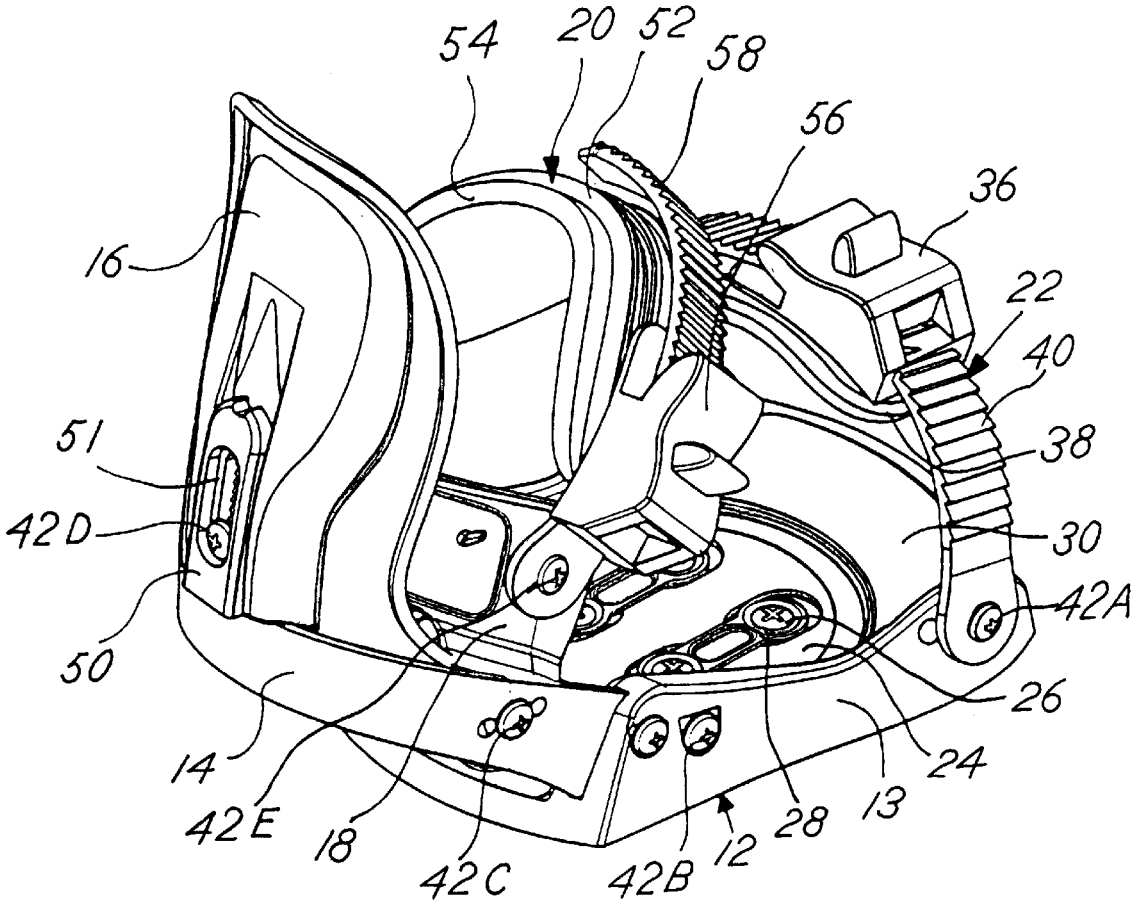
FIG. 2 is an isometric back view of the invention of FIG. 1.
Figure 8:
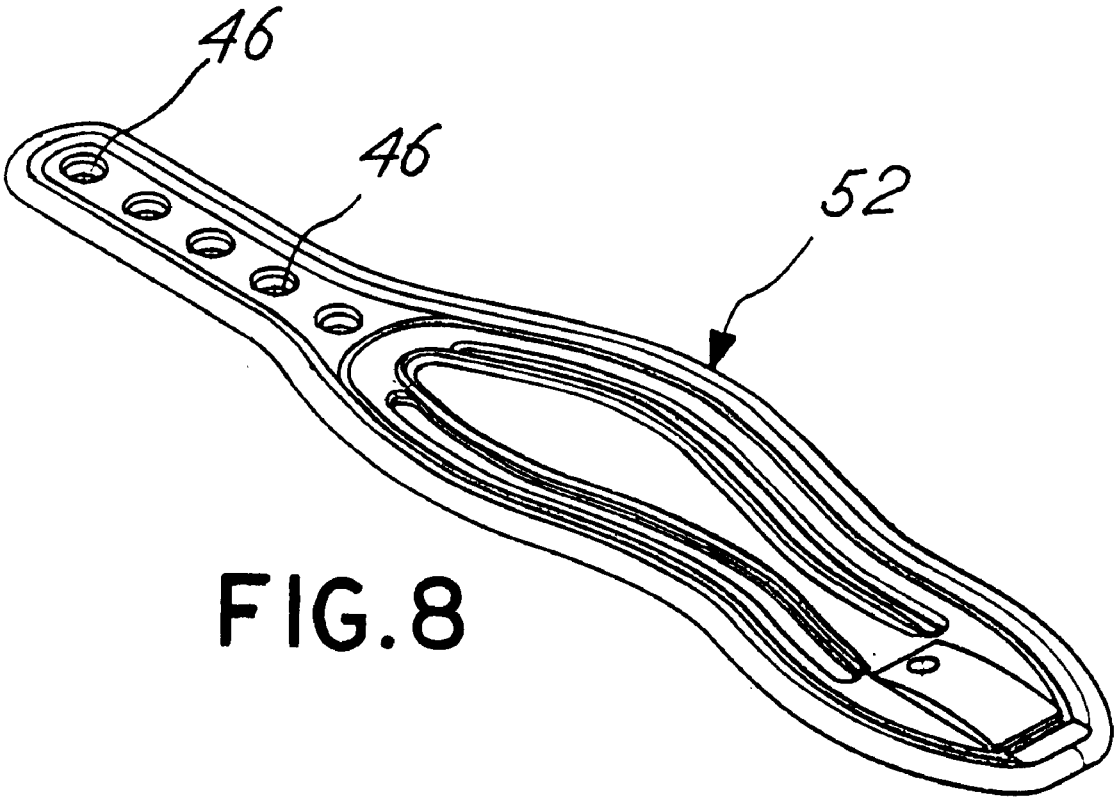
FIG. 8 is an isometric view of the asymmetric ankle strap of the invention of FIG. 1.

Referring to the drawings wherein like numerals indicate like elements, there is shown in FIGS. 1 and 2 a snowboard strap binding 10 made in accordance with the present invention. As above, the strap binding 10 is a snowboarding device that mounts to the top surface of a snowboard and presently fits a soft style snowboard boot. It is contemplated, however, that the strap binding 10 may be adapted to fit other styles of snowboard boots. The strap binding 10 of the present invention creates an integrated interface between the boot and the snowboard and comprises generally a base plate 12, a heel loop 14, a highback 16, a secondary strap device 18, an ankle strap unit 20, and a toe strap unit 22.

The base plate 12 is the foundation of the binding. The base plate 12 keeps the boot in proper alignment by not allowing any side to side slippage and providing for some medial and lateral support. The base plate 12 is securely fastened to the snowboard by a mounting plate 24, a plurality of screws 26, and mounting washers 28. The mounting plate 24 is a circular disc that interfaces with the base plate 12 to allow for longitude or latitude placement of the base plate 12 on the snowboard and also allows for rotational angle adjustments of the base plate 12. By loosening the screws 26, the base plate 12 can be rotated by the user to a desired orientation. The orientation of the base plate will vary depending on the desired stance of the snowboarder and the desired performance of the snowboard. When secured to the snowboard by the mounting plate 24, the base plate 12 is thus responsible for transmitting power, provided by the rider, to the snowboard directly. The base plate 12 and mounting plate 24 may be made from a polycarbonate/polyethylene teraphthalate blend, polycarbonate, long glass-filled polypropylene, or equivalent materials.

Attached to the base plate 12 on opposing sides of the mounting plate 24 are the forefoot pad 30 and heel pad 32. Both of these pads provide cushioning between the boot and the base plate. The pads 30, 32 also provide traction to keep the boot secure in the binding. The pads 30, 32 may be made from an ethylene vinyl acetate or polyurethane foam or a rubber type material.

The base plate 12 provides mounting surfaces along its side walls 13 for the toe strap unit 22 and integrates with the heel loop 14. The toe strap unit 22, mounted to the base plate 12, is a conventional unit that comprises a toe strap 34, a toe buckle 36, a toe strap pad 38, a toe ratchet strap 40 and a plurality of screws 42A and tee nuts 44A. The toe strap unit 22 holds the front of the boot down to the base plate 12 and provides for some medial and lateral support. During snowboarding, to the toe strap unit 22 is mostly used during heel side turns where pressure is applied upward from the board to the toe. The toe strap 34 and toe ratchet strap 40 are fastened to the base plate 12 via the screws 42A and tee nuts 44A. Attached to the bottom of the toe strap 34 is the toe strap pad 38. Mounted to the top of the toe strap 34 is the toe buckle 36. The toe buckle 36 receives the toe ratchet strap 40 in sliding engagement and releasably secures the toe ratchet strap 40 to the toe strap 34, thereby securing the toe of the boot to the base plate 12. The toe strap unit 22 may be made from a suitable polyester based elastomer or equivalent elastomeric polymer.

The heel loop 14, integrated with the base plate 12 through use of screws 42B and tee nuts 44B, provides a ridged structure that supports and transfers forces from the highback 16 and secondary strap device 18 to the base plate 12. The heel loop 14 is U-shaped to serve as a backstop and a pocket that the rear of the snowboard boot fits into to aid in the "fit" of the binding. The heel loop 14 may be made from a variety of materials including steel, plastic, or a composite.

Mounted to the heel loop 14 through screws 42C and tee nuts, not shown, is the highback 16. The highback 16 is the structure that supports the back of the lower leg. The highback 16 has a shape that provides a pocket that the heel of the boot fits into for better hold. Near the top of highback 16, the highback has a flared shape to allow for medial and lateral movement. The highback 16 may be made of a TPU/acrylonitrile-butadiene-styrene blend or TPU or other suitable material. Attached to the highback 16 in the pocket of the highback is a highback pad 48 which provides cushioning for the rear of the leg and boot. The highback pad may be made from an ethylene vinyl acetate or polyurethane foam or other suitable materials.

Referring to FIG. 2, fastened to the back of the highback 16 is a forward lean stop 50. The forward lean stop 50, attached to the highback 16 through use of screw 42D and tee nut 44D, adjusts the forward lean angle of the highback 16. By loosening the screw 42D, the forward lean stop can be slid along slot 51 thereby adjusting the angle of the forward lean of the boot, that is, the angle of the snowboarder's leg with respect to the horizontal plane. The amount of the forward lean of the boot varies with the desired performance of the snowboard. The contemplated forward lean stop 50 allows for an approximate adjustment of 10 to 30 degrees of forward lean. Materials for the forward lean stop 50 include polycarbonate/polyethylene teraphthalate blend, glass filled polypropylene or equivalent material.

Mounted within the pocket formed in the highback 16 is the secondary strap device 18, also known as a bootlock. The bootlock 18 is removably fastened to the heel loop 14 through use of screws 42C and tee nuts, not shown. Mounted to the bootlock 18 is the ankle strap unit 20 which comprises a preferred asymmetrical shaped ankle strap 52, an ankle strap pad 54, an ankle buckle 56, an ankle ratchet strap 58, and screws 42E and tee nuts, not shown. The purpose of the ankle strap unit is to provide heel hold down in the binding as well as providing some of the forward, medial, and lateral support. The asymmetrical ankle strap 52 and ankle ratchet strap 58 are fastened to the bootlock 18 via the screws 42E and tee nuts, not shown. Attached to the bottom of the ankle strap 52 is the ankle strap pad 54. Mounted to the top of the ankle strap 52 is the ankle buckle 56. The ankle buckle 56 receives the ankle ratchet strap 58 in sliding engagement and releasably secures the ankle ratchet strap 58 to the ankle strap 52 thereby securing the heel of the boot to the snowboard.

Referring to FIGS. 8–11, the preferred ankle strap 52 is an asymmetrical single strap that allows for either a stiff fit (higher edge pressure) or a flexible fit (lower edge pressure). Ankle strap adjustment to the desired "fit" and performance of the board is provided by both a plurality of longitudinally spaced apart holes 46 located at one end of the ankle strap 52 and the asymmetrical shape of the ankle strap 52. The plurality of holes 46 on the ankle strap 52 provides for enhanced adjustability of the strap pressure on the boot.

As depicted in FIGS. 9 and 11, the preferred shape of the ankle strap 52 is asymmetric about the longitudinal axis of the ankle strap 52. With the asymmetric shape of the ankle strap 52, depending on which side of the base plate the ankle strap 52 is mounted will affect the degree of pressure placed on the boot. For example, if the ankle strap 52 is mounted with the contour 53 directed toward the toe of the boot, a more flexible fit across the top of the boot will result. In contrast, if the ankle strap 52 is mounted with the contour 53 directed toward the leg, a tighter fit will result. Conventional ankle straps are symmetric laterally and simply do not provide this performance adjustability. This asymmetric shape is thus a benefit to the user since they can either choose the flexible setting which allows more freedom of motion used for freestyle snowboarding moves, or the tighter setting which provides increased support and more edge control for snow carving. While it is preferable to use the asymmetric shaped strap, it is contemplated and within the scope of the invention to use a conventional symmetric strap.

Significantly, the asymmetric ankle strap 52 of the present invention may also be attached directly to and used with a step-in snowboard boot. As above, the user can mount the asymmetric ankle strap 52 with the contour 53 directed toward the toe of the boot for greater boot flexibility. Alternatively, the user can mount the ankle strap 52 with the contour 53 directed toward the leg resulting in a tighter binding fit and more board edge control.

Referring to FIGS. 1–7, the bootlock 18 of the present invention provides better heel hold with less pressure across the top of the boot from the ankle strap 52. The overall shape of the bootlock 18 compliments the heel pocket created by the highback 16 and the heel loop 14. As a result, the shape of the bootlock 18 avoids the stacking up of material, thereby creating a clean interface for the boot. The bootlock 18 includes spaced apart openings 60 on both ends of the bootlock 18. These openings 60 allow for selective adjustment of the ankle strap unit 20 to the bootlock 18 for increased stiffness or, alternatively, for more flex of the binding. For example, by using openings 60 that are higher and further back toward the highback 16, the bootlock 18 will pull tighter against the boot with the same pressure against the ankle strap 52. This will result in a stiffer, more responsive binding. By using the forward and lower openings 60, the snowboarder will gain a greater range of motion. The two ends of the bootlock 18 may also be adjusted independently to gain more support or more range of motion in either medial or lateral directions. It is preferred that the bootlock 18 have three openings 60 on each end for positioning of the ankle strap unit 20. However, it is contemplated that the number and location of the openings 60 may vary and still be considered within the scope of the invention. The bootlock 18 also has two opposing mounting holes 61 for mounting the bootlock 18 to the heel hoop 14.

The inner surface 62 of the bootlock 18, that is, the surface in contact with the boot, is textured to allow the boot to slip downward into the binding but resists upward movement. The textured inner surface 62 allows the boot to slide back down into the binding when, for example, the boot works loose due to a large impact or, alternatively, snowpack in the binding breaks loose.

In operation, as a snowboarder exerts pressure on the ankle strap, the ankle strap pulls on the bootlock and draws the bootlock tighter around the back of the boot above the heel. This results in the bootlock applying a downward force onto the heel, thereby keeping the heel in close contact with the snowboard and resulting in enhanced snowboard performance. The bootlock also has the effect of reducing the pressure exerted by the ankle strap on the top of the boot to improve comfort around the ankle.

The bootlock 18 can be made from a variety of different materials including HYTREL® made by DuPont or TEXIN® made by Bayer. Alternatively, the bootlock 18 can be made out of textile materials, or a composite of materials such as textiles and plastics.

The preferred embodiments of the invention are now described as to enable a person of ordinary skill in the art to make and use the same. Variations of the preferred embodiments are possible without being outside the scope of the present invention. For example, it is contemplated that the bootlock be not limited to the current mounting configuration. Other mounting possibilities exist which include fixing the bootlock to the rear of the binding to the highback or heel loop, or fixing the bootlock directly to the base plate. Other variations of the bootlock could include extending the bootlock forward to incorporate the toe strap. It is also contemplated that the bootlock could be made for specific boots and mounted directly to the board without a conventional base plate. It is also foreseeable that the bootlock and/or ankle strap may be integrated with the boot such as with a step-in boot. Therefore, to particularly point out and distinctly claim the subject matter regarded as the invention, the following claims conclude the specification.

What is claimed is:

1. A snowboard binding comprising:

a base plate defining opposing side walls, a toe strap mounted to said base plate, a heel portion mounted to and extending between said opposing side walls of said base plate, a strap assembly connected to said heel portion, said strap assembly defining a secondary strap and an ankle strap mounted to said secondary strap, said secondary strap extending between said opposing side walls of said base plate and being located in front of the heel portion and adapted to wrap around the back of a user's foot.

2. The snowboard binding of claim 1 further comprising a mounting plate attaching said base plate to a snowboard.

3. The snowboard binding of claim 1 wherein a highback is mounted to said heel portion.

4. The snowboard binding of claim 1 wherein said heel portion is a heel loop.

5. The snowboard binding of claim 1 wherein said secondary strap has a textured surface and a plurality of openings at each end of said secondary strap.

6. The snowboard binding of claim 5 wherein said ankle strap is mountable to any of said plurality of openings of said secondary strap.

7. The snowboard binding of claim 1 wherein said ankle strap has at one end a plurality of holes for selective tightening of said ankle strap to said secondary strap.

8. A snowboard binding comprising:

a base plate defining opposing side walls, a toe strap mounted to said side walls of said base plate, a heel loop mounted to said side walls of said base plate, a high back mounted to said heel loop, a strap assembly mounted to said heel loop, said strap assembly defining a secondary strap and an ankle strap, said secondary strap extending between said opposing side walls of said base plate and being adapted to wrap around the back of a user's foot.

9. The snowboard binding of claim 8 wherein said secondary strap is a strap having a textured surface and a plurality of openings at each end.

10. The snowboard binding of claim 9 wherein said ankle strap adjustably mounts to any of said plurality of openings of said secondary strap.

11. The snowboard binding of claim 8 wherein said ankle strap is asymmetric having at one end a plurality of holes for selective tightening of said ankle strap to said secondary strap.

12. The snowboard binding of claim 8 wherein said base plate is rotatably fastened to a snowboard by a mounting plate.

* * * * *